US006837828B2

(12) United States Patent
Kyoung-chan et al.

(10) Patent No.: US 6,837,828 B2
(45) Date of Patent: Jan. 4, 2005

(54) ELASTICITY-CONTROLLABLE TRAMPOLINE USING PLATE SPRING

(76) Inventors: Oh Kyoung-chan, 2-805, Geosung-green Apt, 545-1, 2Ga Jungwhasan-dong, Wansan-Ku, Jeonju-City 560-250, Seoul (KR); Oh Ju-whan, 2-805, Geosung-green Apt, 545-1, 2Ga Jungwhasan-dong, Wansan-Ku, Jeonju-city 560-250, Seoul (KR)

( * ) Notice: Subject to any disclaimer, the term of this patent is extended or adjusted under 35 U.S.C. 154(b) by 150 days.

(21) Appl. No.: 10/257,880

(22) PCT Filed: Apr. 17, 2001

(86) PCT No.: PCT/KR01/00635

§ 371 (c)(1),
(2), (4) Date: Feb. 11, 2003

(87) PCT Pub. No.: WO01/85262

PCT Pub. Date: Nov. 15, 2001

(65) Prior Publication Data

US 2004/0092366 A1 May 13, 2004

(51) Int. Cl.[7] ..... A63B 5/12
(52) U.S. Cl. ..... 482/52; 482/32
(58) Field of Search ..... 482/51–53, 71, 482/34, 15, 26–32

(56) References Cited

U.S. PATENT DOCUMENTS 3,062,542 A * 11/1962 Evancha ..... 482/34
3,628,791 A * 12/1971 Garcia ..... 482/51
3,638,940 A * 2/1972 Mehaulic ..... 482/51
3,831,935 A * 8/1974 Hofle ..... 482/71
4,341,380 A 7/1982 Sauder
4,477,070 A 10/1984 Appelbaum
4,645,197 A 2/1987 McFee

* cited by examiner

*Primary Examiner*—Stephen R. Crow
(74) *Attorney, Agent, or Firm*—Jonathan Alan Quine; Quine Intellectual Property Law Group, P.C.

(57) ABSTRACT

Disclosed is an elasticity-controllable trampoline using a plate spring that can be manufactured in small size and in low height compared with existing trampolines using coil springs, thereby proving stability to a user. Also, it has a mechanical structure, thereby providing a semi-permanent life term. Under the principles of a lever using the third law of motion, particularly, the plate spring carries out action in smooth manner, in operation and also carries out reaction with the jumping operation of the user, such that the trampoline of the present invention will have a strong elasticity. In addition, a plate spring support movable stand on the plate spring is moved in simple manner according to the principles of the lever, thereby allowing the elasticity of the plate spring to be controlled. With the adjustment of the upward and downward motion of an action point operation bolt, the height of the upward and downward motion can be adjusted. Specifically, the step plate is maintained at a horizontal state, upon upward and downward motion, by the adoption of a coupling movable member for maintaining the step plate horizontally, and a bearing sheet is formed on the step plate with a result that the step plate can carry out a twist motion.

3 Claims, 5 Drawing Sheets

ELASTICITY-CONTROLLABLE TRAMPOLINE USING PLATE SPRING

TECHNICAL FIELD

The present invention relates to an elasticity-controllable trampoline using a plate spring.

BACKGROUND ART

A conventionally developed trampoline operates in such a manner that a plurality of coil springs are coupled to an iron frame, so that it occupies a relatively large area. Moreover, the trampoline can control the elasticity thereof only with the attachment and detachment of the coil springs. The trampoline is formed by fabrics, thereby making it difficult for a user to maintain a horizontal level, and it is also difficult to install a handle grip thereon in terms of the characteristics of the trampoline, thereby not providing any stability to the user. In addition, serious noises are caused at the time of friction between the plurality of coil springs. Because of these problems, there is a need for a novel small-sized trampoline capable of providing stability and convenience to the user.

DISCLOSURE OF INVENTION

It is an object of the present invention to provide an elasticity-controllable trampoline, using a plate spring adopting lever principles, in which upon action it operates by the lever principles and upon reaction it exerts an elastic force at a time, under the law of action and reaction as third law of motion, whereby the trampoline produces a strong elastic force at an expense of small force, has a relatively low height relative to an operation distance, provides a step plate that is level with the surface of land, thereby permitting the stability of use, occupies a relatively small area, controls the available elasticity if necessary, adjusts the motion height (the operation distance) if necessary and does not produce any noise, such that it can be effective as indoor sporting goods, manufactured at a low production cost and semi-permanently used for a long period of time.

To accomplish the above objects of the present invention, there is provided an elasticity-controllable trampoline using a plate spring, which includes: a fixed plate and a step plate coupled by means of a knuckle pin on the both sides of a step plate coupling movable member and a coupling movable member for maintaining the step plate horizontally; the plate spring operated by means of an action point operation bolt; and a plate spring support movable stand moved by the rotation of a horizontal moving shaft with a thread for moving the plate spring support movable stand, whereby the elasticity of the plate spring can be controlled and upward and downward motion distance can be controlled under a length control by means of the action point operation bolt.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Figure 1:
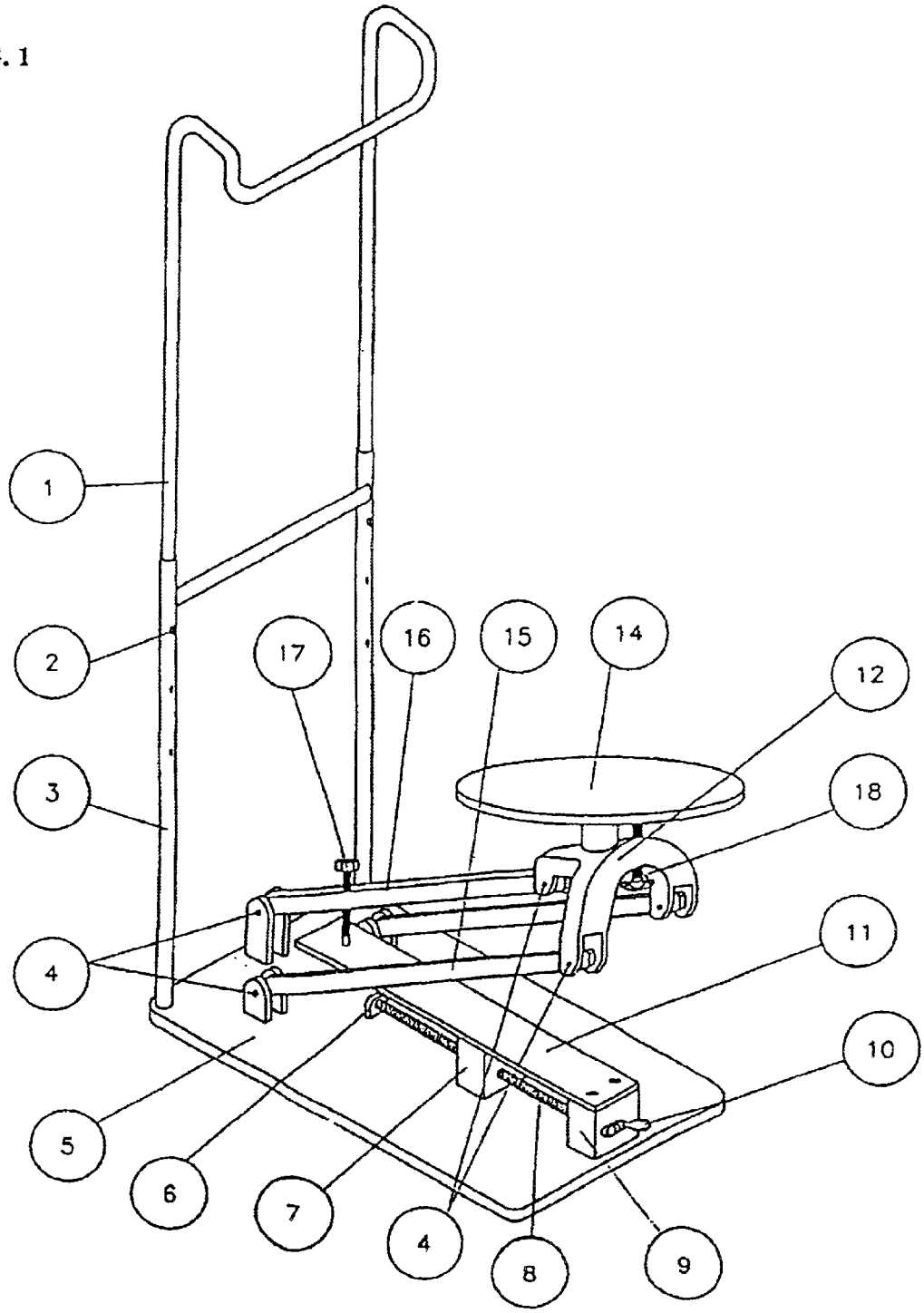
FIG. 1 is a perspective view of an elasticity-controllable trampoline using a plate spring according to an embodiment of the present invention.
Figure 2:
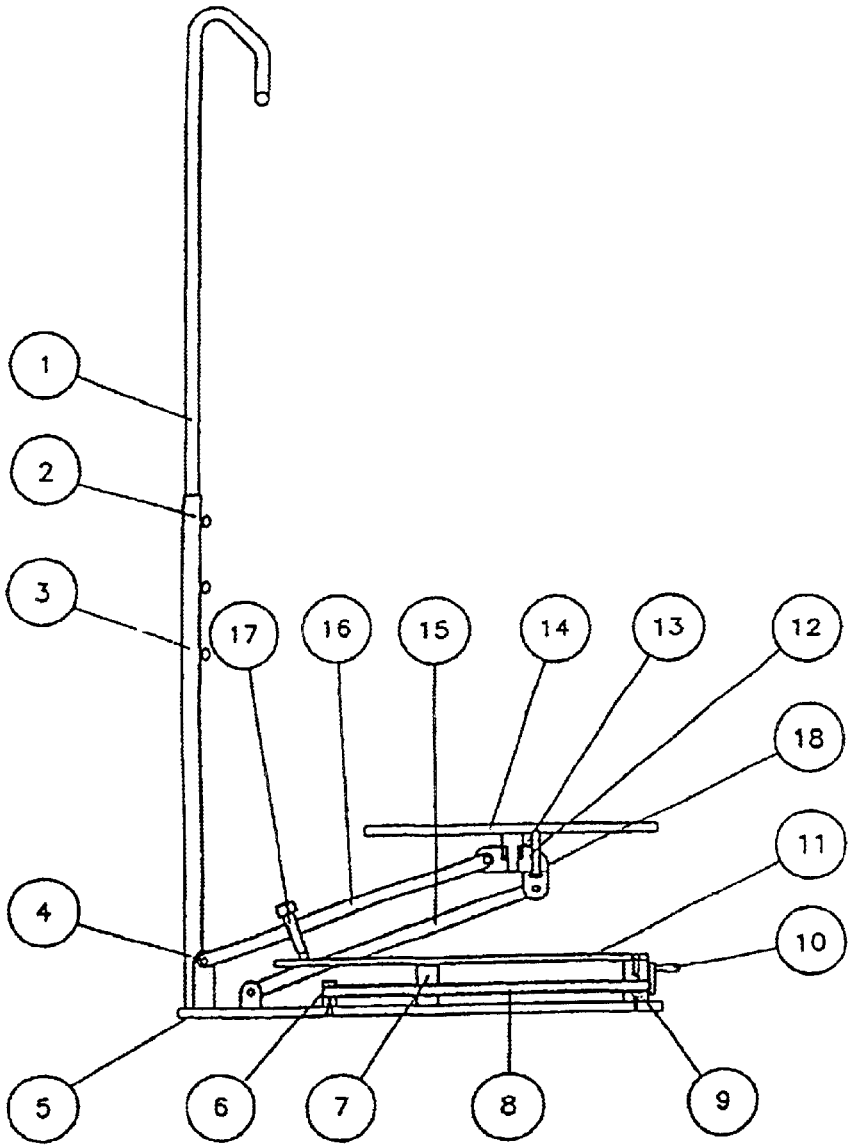
FIG. 2 is a sectional view of the elasticity-controllable trampoline of the present invention.

According to the present invention, as shown in FIGS. 1 and 2 an elasticity-controllable trampoline using a plate spring is constructed in such a manner that a step plate 14 is coupled on the upper end of a fixed plate 5 with a step plate coupling movable member 16 and a coupling movable member 15 for maintaining the step plate 14 horizontally via a knuckle pin 4, with a result that the step plate 14 can be operated upward and downward. Thus, the step plate 14 operates at the expense of small force by virtue of an action point operation bolt 17 under the principles of a lever. Moreover, the plate spring 11 adopts the principles of the lever in accordance with the movement of a plate spring support movable stand 7. As a result, the principles of the lever are embodied twice in the elasticity-controllable trampoline according to the present invention. Thereby, the trampoline of the present invention operates under the third law of motion.

The plate spring 11 is secured at the one side thereof by virtue of a holder 9 for a horizontally moving shaft 8 and operates upward and downward, based upon the operation force of the action point operation bolt 17. And, the plate spring support movable stand 7 moves on the thread of the horizontally moving shaft 8, thereby providing an effect of moving the support point of the lever. Therefore, a degree of action of force is varied in proportional to the operation distance, such that the elastic force the plate spring 11 has can be controlled. The upward and downward motion distance is adjusted by the rotation of the action point operation bolt 17, such that the upward and downward motion distance of the step plate 14 can be controlled. In order to eliminate friction around the pin of the action point operation bolt 17, a ball bearing is inserted into the action point operation bolt 17. The coupling movable member 15 for maintaining the step plate 14 horizontally can operate in horizontal relation with the step plate 14 by virtue of the movable member and the knuckle pin 4 on the step plate 14 and the fixed plate 5.

Under the aforementioned construction, an explanation of the operation and effect of the trampoline of the present invention will be below discussed. A rotary handle grip 10, which is coupled to the horizontal moving shaft 8 with the thread for moving the stand 7, rotates left and right, with a result that the plate spring support movable stand 7 is positioned at a predetermined location, thereby permitting the elastic force available to be determined. As the action point operation bolt 17 rotates left and right, it is adjusted in length, so that the height of the motion is controlled. Under the above state, if a user gets and stamps on the step plate 14, the force is applied to the step plate coupling movable member 16 coupled to the step plate 14, with a consequence that the action point operation bolt 17 makes the plate spring 11 descended. When the operation elasticity reaches a limit, the step plate 14 is ascended by the action of a strong restoring force of the plate spring 11, with a result that the user can be elastically jumped. At this time, the principles of the lever adopted repeatedly by the location of the plate spring support movable stand 7 and the operation position of the action point operation bolt 17 are employed with the elasticity of the plate spring 11 in mixed relation to each other, so that a substantially strong elastic force from the plate spring 11 can be exhibited at the expense of small force. Also, the rotation of the step plate 14 is made by virtue of a bearing sheet that is disposed on a step plate fixing member 12.

Figure 3:
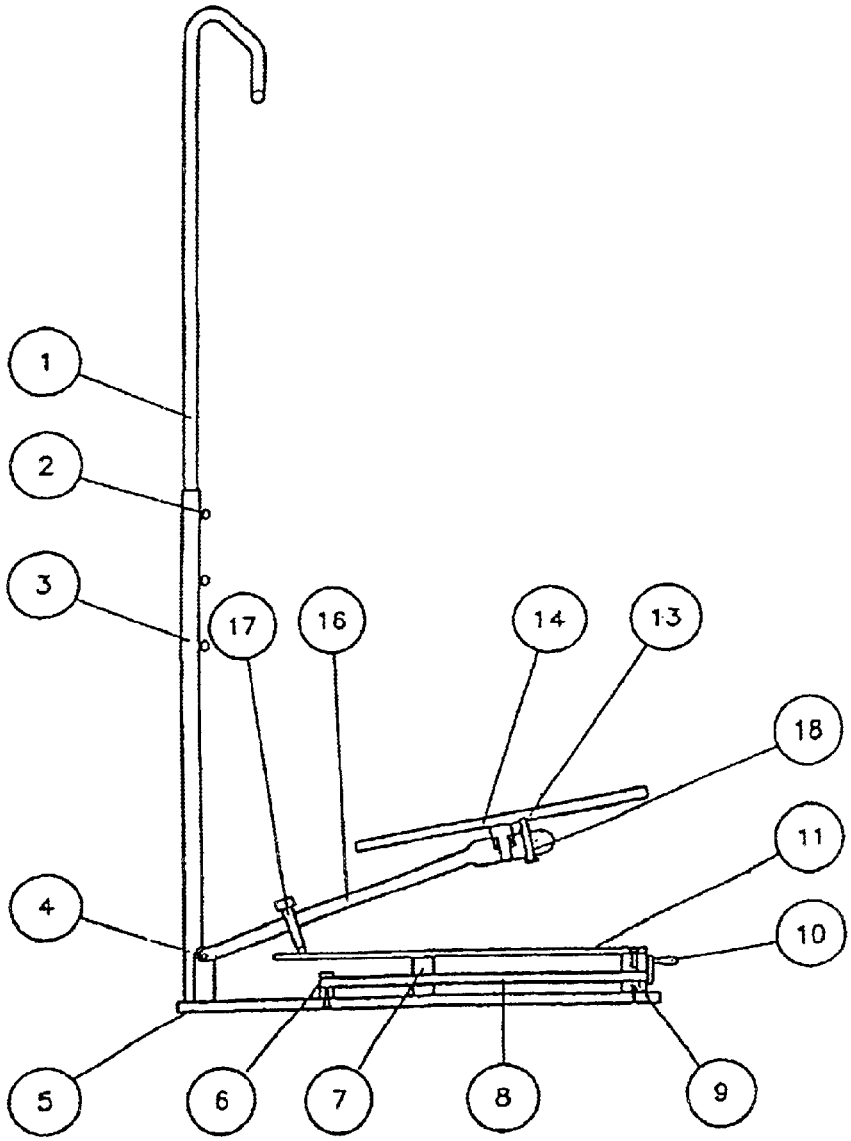
FIGS. 3 to 5 are sectional views of the elasticity-controllable trampoline according to another embodiments of the present invention.

Referring to FIG. 3 showing the elasticity-controllable trampoline using the plate spring according to another embodiment of the present invention, only the step plate coupling movable member 16 is coupled on the fixed plate 5 by means of the knuckle pin 4, and the step plate coupling movable member 16 is integrally coupled with the step plate 14 on the other side thereof.

Figure 4:
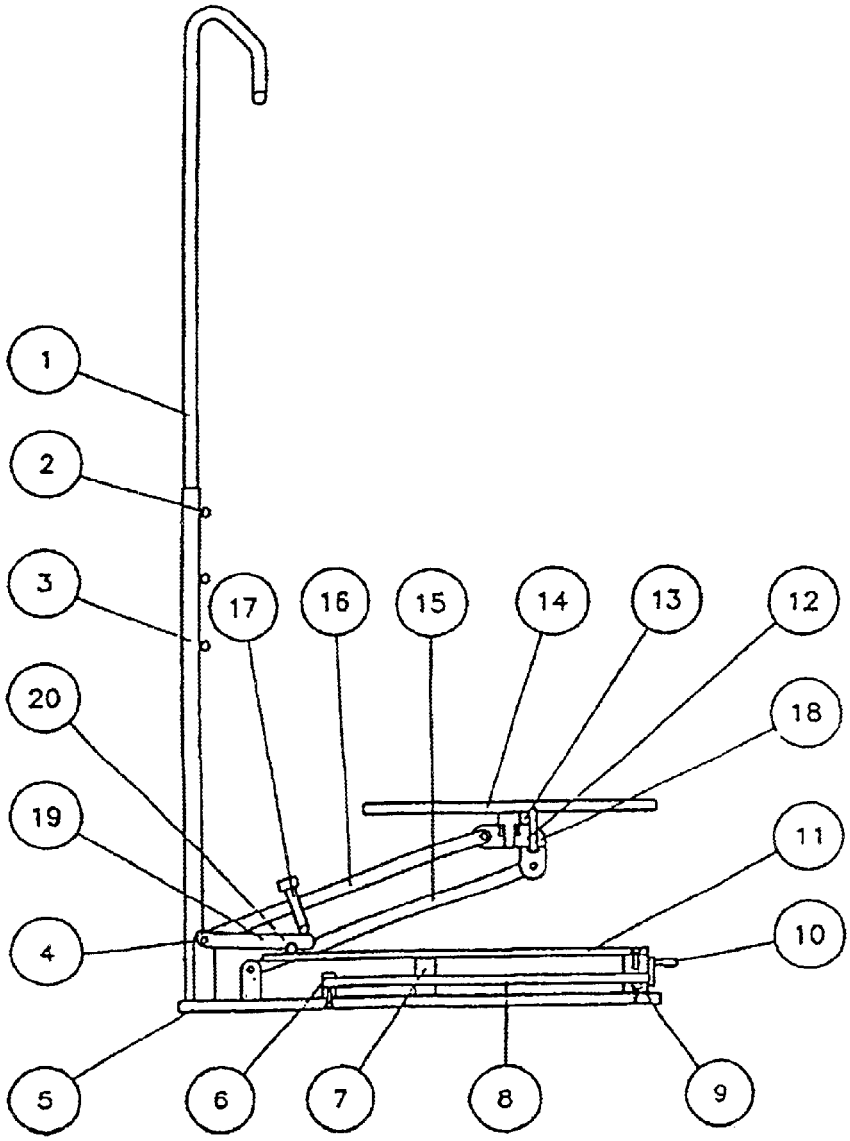
Figure 5:
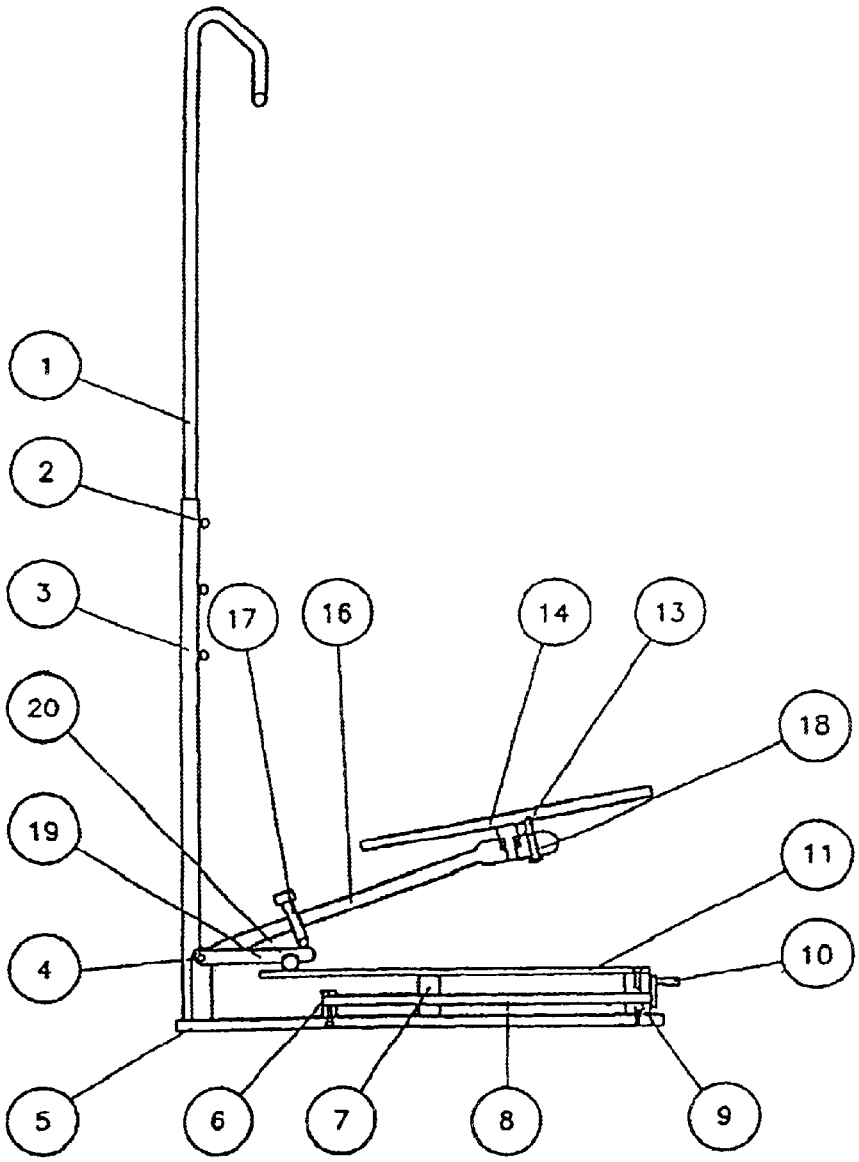

Referring to FIGS. 4 and 5 showing the elasticity-controllable trampoline using the plate spring according to yet another embodiments of the present invention, a roller 20 is coupled on a plane plate 19, and the action point operation bolt 17, which is integrally formed with the step plate coupling movable member 16, operates on the plane plate 19 such that the elastic force of the plate spring 11 and the operation of the step plate 14 become smooth.

INDUSTRIAL APPLICABILITY

As set forth in the foregoing, an elasticity-controllable trampoline using a plate spring according to the preferred embodiments of the present invention operates by double adoption of the principles of a lever and utilizes the elastic force of the plate spring, whereby it exhibits an excellent elasticity, thereby providing a strong jumping force to a user at the time of operation. In addition, the trampoline of the present invention can control the elasticity thereof and the width of upward and downward motion. Moreover, it can maintain a step plate at a horizontal state upon upward and downward motion, and the height of the step plate is substantially low when compared with the operation distance, thereby providing stability to the user. Also, it is manufactured in small size such that it is easy to move, and it is also manufactured at a low production cost such that it has competition in price. Based upon the above, it can be appreciated that the trampoline of the present invention will be the indoor sporting goods having an excellent effect.

What is claimed is:

1. An elasticity-controllable trampoline using a plate spring, comprising:

a fixed plate and a step plate coupled by means of a knuckle pin on both sides of a step plate coupling movable member and a coupling movable member for maintaining said step plate horizontally;

said plate spring operated by means of an action point operation bolt; and a plate spring support movable stand moved by the rotation of a horizontal moving shaft with a thread for moving said plate spring support movable stand, whereby the elasticity of said plate spring can be controlled and upward and downward motion distance can be controlled under a length control by means of said action point operation bolt.

2. The trampoline as defined in claim 1, wherein only said step plate coupling movable member is coupled on said fixed plate by means of said knuckle pin, and said step plate coupling movable member is integrally coupled with said step plate on the other side thereof.

3. The trampoline as defined in claims 1 to 2, wherein said action point operation bolt, which is integrally formed with said step plate coupling movable member, operates on a plane plate to which a roller is coupled, such that the elastic force of said plate spring and the operation of said step plate become smooth.

* * * * *